US006023933A

United States Patent [19]

Langan et al.

[11] Patent Number: 6,023,933

[45] Date of Patent: Feb. 15, 2000

[54] ULTRA HIGH PRESSURE GASES

[75] Inventors: John Giles Langan, Wescosville; Wayne Thomas McDermott, Fogelsville; Richard Carl Ockovic, Northampton, all of Pa.

[73] Assignee: Air Products and Chemicals, Inc., Allentown, Pa.

[21] Appl. No.: 08/963,728

[22] Filed: Nov. 4, 1997

[51] Int. Cl.[7] ..... F17C 9/02

[52] U.S. Cl. ..... 62/50.2; 62/924

[58] Field of Search ..... 62/50.2

[56] References Cited

U.S. PATENT DOCUMENTS

| | | | |
|---|---|---|---|
| 3,246,634 | 4/1966 | Stevens | 62/50.2 |
| 3,597,934 | 8/1971 | Anderson et al. | 62/50.2 |
| 4,032,337 | 6/1977 | Boyer | 75/226 |
| 5,373,702 | 12/1994 | Kalet et al. | 62/50.2 |
| 5,540,059 | 7/1996 | Yokokawa | 62/50.2 |

*Primary Examiner*—Ronald Capossela
*Attorney, Agent, or Firm*—Geoffrey L. Chase

[57] ABSTRACT

A method and apparatus for pressurizing a high purity gas in liquefied form to an ultra high pressure gas in vapor form using a constant volume, heated vaporization vessel.

21 Claims, 2 Drawing Sheets

ULTRA HIGH PRESSURE GASES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Processes, such as vapor deposition of thin metal films on silicon wafers, require the use of high purity gas at high pressures. For example, certain newly developed physical vapor deposition processes utilized by the semiconductor industry require the use of high purity argon at pressures greater than 10,000 psia. Any significant amount of particulate or molecular contaminants, such as various fluorocarbon or hydrocarbon compounds in the argon can contaminate silicon wafer surfaces, and reduce microchip yield to uneconomical levels. Therefore, contamination of argon in such applications must be avoided.

Avoidance of contamination in high pressure argon systems is difficult. A typical means for providing argon at pressures greater than 10,000 psia is through mechanical compression of argon gas. The most reliable mechanical compressors, i.e., those having the longest operating periods between maintenance, use pistons with compression seals to separate the pressurized argon from a hydraulic fluid. Such seals are prone to wear, leak-through, and subsequent contamination of the high purity argon. An alternative compressor design uses an oscillating metal diaphragm to separate the pressurized argon from a hydraulic fluid. However, the diaphragms of such compressors are prone to fatigue failure and require frequent maintenance. Fatigue failure of the diaphragm in such compressors results in contamination of the argon with particles and other impurities.

An alternative means of supplying high pressure argon consists of a two step process in which liquid argon is first compressed to high pressure using a cryogenic liquid pump. The pressurized argon then flows to a separate vessel where heat is transferred into the argon at a fixed, high pressure. The heat transfer raises the temperature of the argon to the ambient level. Using this method, cryogenic liquid pumps can be used to produce argon pressures greater than 10,000 psia as disclosed in U.S. Pat. No. 4,032,337. However, cryogenic liquid pumps require frequent maintenance and liquid sub-cooling to minimize cavitation, and can contaminate the argon with particles or other impurities.

The present invention overcomes the drawbacks of the prior art to avoid contamination of lubricating oils and metals, to avoid the complexity of mechanical compression, and yet provides a simple, clean method of obtaining ultra high pressures in gases having high purity requirements as industry currently demands, as set forth in greater detail below.

BRIEF SUMMARY OF THE INVENTION

The present invention is a method of pressurizing a high purity gas to ultra high pressure while maintaining the high purity of the gas, comprising the steps of;

a) providing a high purity gas in a liquefied physical state;

b) introducing the high purity gas in a liquefied physical state into a vaporization vessel;

c) closing the vaporization vessel after it is at least partially filled with the high purity gas in a liquefied physical state; and d) heating the vaporization vessel and the high purity gas in a liquefied physical state which at least partially fills the vessel to vaporize the high purity gas and to pressurize the high purity gas to the ultra high pressure.

Preferably, the heating step d) is performed by indirect heat exchange of the high purity gas in a liquefied physical state with a heating fluid in the vaporization vessel.

Preferably, the ultra high pressure is at least 2,000 psia.

More preferably, the ultra high pressure is at least 8,000 psia.

Most preferably, the ultra high pressure is in the range of approximately 10,000 to 67,000 psia.

Preferably, the high purity is at least 99.9% by volume of the gas, more preferably 99.999% and most preferably 99.9999%.

Preferably, the high purity gas is pressurized in a one of a plurality of parallel connected vaporization vessels, wherein when one vaporization vessel is being filled by introduction of high pressure gas in a liquefied physical state, the other vaporization vessels are dispensing the vaporized high purity gas at ultra high pressure and heating the high purity gas in a liquefied physical state, respectively.

In one alternative, the high purity gas at an ultra high pressure is introduced into storage cylinders.

Preferably, the high purity gas at an ultra high pressure is delivered to a downstream semiconductor process as a source of pressurization.

Preferably, the high purity gas is recycled from the semiconductor process to a gas liquefier and then to the vaporization vessel.

Preferably, the high purity gas is selected from the group consisting of argon, nitrogen, oxygen, helium, hydrogen and mixtures thereof. More preferably, the high purity gas is argon.

The present invention is also an apparatus for pressurizing a high purity gas to ultra high pressure while maintaining the high purity of the gas, comprising a) a liquefier for liquefying the high purity gas having at least two indirect heat exchange passageways through which a cooling medium passes in indirect heat exchange in one such passage and through which a high purity gas being liquefied passes in indirect heat exchange in another such passage;

b) a storage vessel connected to the liquefier to receive and store the high purity gas after it has been liquefied;

c) at least one vaporization vessel connected to the storage vessel having at least one orifice to receive and dispense the high purity gas, an indirect heat exchanger in heat exchange with the vessel for heating the high purity gas, and means to sense the amount of the high purity gas in the vessel; and d) means for controllably dispensing the high purity gas at ultra high pressure from the vaporization vessel.

Preferably, the means for controllably dispensing the high purity gas at ultra high pressure is a valved conduit connected from the vaporization vessel to a downstream semiconductor process apparatus.

Preferably, the means for controllably dispensing the high purity gas at ultra high pressure is a valved conduit removably connected from the vaporization vessel to one or more downstream storage cylinders.

Preferably, piping is provided to recycle the high purity gas at ultra high purity from the means to controllably dispense to the liquefier.

Preferably, the vaporization vessel comprises three parallel connected vaporization vessels.

Preferably, the vaporization vessel has the indirect heat exchanger situated inside the vessel.

Preferably, the vaporization vessel has an outer pressure containment casing, an intermediate insulating layer, an inner gas containing casing and an indirect heat exchanger having passageways for flow of heating fluid through the indirect heat exchanger wherein the passageways have fins projecting outward to provide increased heat exchange surface.

DETAILED DESCRIPTION OF THE INVENTION

Figure 1:
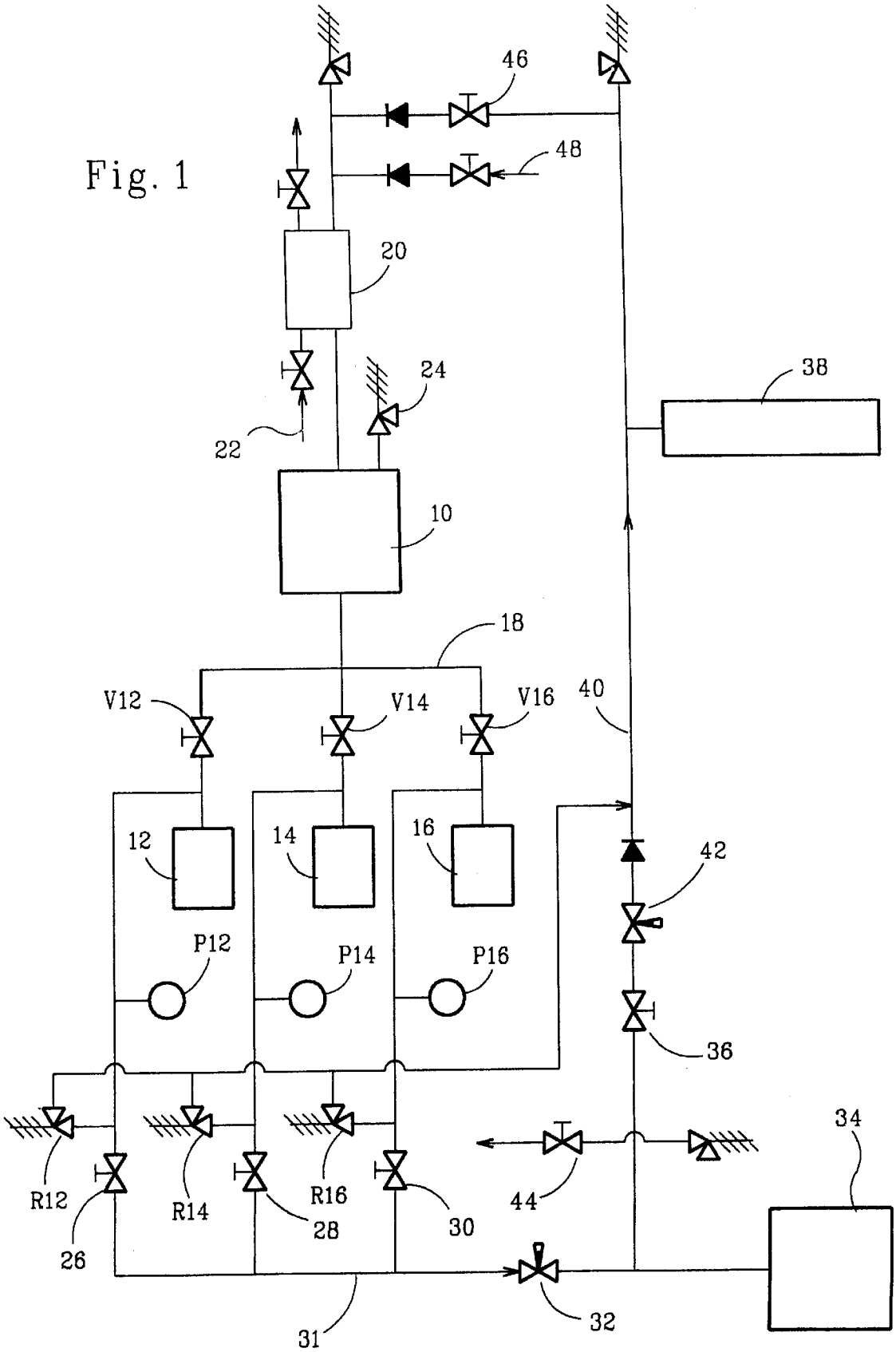
FIG. 1 is a schematic illustration of a first preferred embodiment of the present invention for supply of argon to a semiconductor process.

A method and apparatus are disclosed for the isochoric (constant volume) vaporization of liquefied gas to produce ultra high pressure, high purity gas. Liquefied high purity gas is delivered to a vaporization vessel which is then sealed. Heat is then transferred into the vessel to vaporize the liquefied gas, and raise the temperature of the gas to ambient. The ultra high pressure, high purity gas is then transferred to a silicon wafer processing tool, gas cylinder, or other receiver. The invention can produce argon at pressures as high as approximately 66,400 psia.

The present invention provides an improved method and apparatus for producing ultra high pressure gas at high purity. The invention uses vaporization of liquefied gas in a sealed vessel as a means to produce high pressure. Such pressurized gas may be delivered to various receivers, including silicon wafer processing tools requiring pressures greater than 10,000 psia, and high purity gas cylinders for the electronics industry requiring pressures of approximately 2,500 psia.

Ultra high pressure shall mean for the purpose of the present invention pressures of at least 2,000 psia, preferably at least 8,000 psia, most preferably in the range of approximately 10,000 to 67,000 psia.

High purity shall mean for the purpose of the present invention gas purity of 99.9% by volume of the gas, preferably 99.999% by volume of the gas, most preferably 99.9999% by volume of the gas.

A typical isochoric (constant volume) argon compression system for a silicon wafer processing tool is shown in FIG. 1. This embodiment of the invention includes an argon recovery system to recycle used argon. Liquid argon (LAR) is stored in a thermally insulated LAR dewar or storage vessel 10. The LAR can be stored at near atmospheric pressure at a boiling point temperature of −302.6° F. The idea requires at least one LAR vaporization vessel located downstream of the dewar 10. In this embodiment three vaporization vessels, 12, 14 and 16, respectively, are shown below the LAR dewar 10 in FIG. 1. Multiple vaporization vessels increase the speed of the process by permitting sequential operation. As one vessel is flowing pressurized argon to the tool, the other two vessels are being charged with LAR from the dewar or vaporizing a LAR charge.

Three vaporization vessels are shown in this embodiment for illustrative purposes. Any number of vaporization vessels can be used in this invention.

Each vaporization vessel 12, 14 and 16 has a LAR supply valve V12, V14 and V16, respectively, located on its top. The LAR supply valve is opened to flow LAR from the dewar 10 down into the vaporization vessel through manifold 18. As the LAR contacts the ambient temperature vaporization vessel, initial liquid flashing will occur. Flashed vapor returns upward to the LAR dewar 10 as liquid flows downward. Flashed vapor will tend to increase the pressure of the LAR dewar 10. The flashed vapor is therefore re-liquefied in an argon liquefier 20 located above the argon dewar 10. The liquefier 20 may, for example, consist of a heat exchanger (e.g., plate and fin) with liquid nitrogen (LIN) 22 used as the cooling medium. The head pressure on the LAR dewar 10 (14.7 psia in this embodiment) is maintained by the dewar's internal typical vaporizer/pressure relief system as well known in the industrial gas industry (not shown). A pressure relief valve 24 on the LAR dewar 10 protects it from over-pressurization.

After the vaporization vessel, 12, 14 or 16, respectively, cools to the LAR temperature (−302.6° F.), LAR will begin to fill the vessel. When the vaporization vessel is charged with LAR to a desired depth, the valve V12, V14 or V16, respectively, is closed, and the vessel is sealed. Heat is then transferred to the captured LAR. The transferred heat vaporizes the LAR in the vessel. As additional heat is transferred, the temperature of the argon rises to the ambient level. During this vaporization and heating process, high pressures are produced in the vessel.

The final argon pressure in the vaporization vessel can be predicted from the known volume of the initial LAR charge. For example, it is known that the density of LAR at the normal boiling point is 86.82 LB/ft$^3$. Also, at the normal boiling point, the density of the cold gaseous argon in the head space of the sealed vessel is known to be 0.36 LB/ft$^3$. If the LAR charge is allowed to occupy 83.4% of the volume of the vessel, then the cold gaseous argon occupies the remaining 16.6% of the volume of the vessel. In this case, the average density of all the argon in the vessel is 0.834 (86.82)+0.166 (0.36)=72.47 LB/ft$^3$. The internal volume of the vessel and the mass of argon in the vessel remain unchanged during the heat transfer process. Therefore, after the argon in the vessel is vaporized and warmed to 70° F., the average density of the captured argon remains at 72.47 LB/ft$^3$. Under these conditions of temperature and density the predicted final pressure of the argon in the vessel is 25,000 psia.

By using a smaller initial quantity of LAR in the vessel, lower final pressures can be achieved after the heat transfer process. Conversely, by using a greater initial quantity of LAR in the vessel, higher final pressures can be achieved. The highest theoretically achievable pressure is obtained when the vessel is completely filled with LAR, leaving no head space in the charged vessel. In this case the average density of the captured argon in the vessel is equal to that of the liquid, 86.82 LB/ft$^3$. After the argon is vaporized and warmed to 70° F. the argon achieves a final predicted pressure of 66,400 psia. Therefore, when starting with LAR at an initial pressure of 14.7 psia, final pressures as high as approximately 66,400 psia are possible using this method.

Each vaporization vessel 12, 14 and 16 has a pressure sensor P12, P14 or P16, respectively and an automatically actuated pressure relief valve R12, R14 or R16, respectively. The pressure relief valve is set to open at the desired final argon pressure. The relief valve may, for example, be set at a desired pressure in the range 2,000 psia to 30,000 psia. If the vaporization vessel pressure exceeds the desired pressure, the relief valve opens and the argon flows through the relief valve to the argon recovery system. After the relief valve has opened, no further increase in vessel pressure occurs.

When the wafer processing tool requires pressurized argon, valve 26, 28 or 30, respectively, is opened in conduit 31. The pressurized argon then flows through a fine metering valve 32 to the semiconductor wafer processing tool 34. The fine metering valve 32 is set to control the flow of argon and rate of pressurization of the processing tool 34. When the tool 34 is pressurized to the required pressure, valve 26, 28 or 30, respectively, is closed.

When the tool cycle is complete, tool valve 36 is opened, and the tool 34 is de-pressurized. Valve 26, 28 or 30, respectively, is also re-opened at this time to de-pressurize the vaporization vessel, 12, 14 or 16, respectively. In this embodiment of the invention, the used argon flows to a low pressure cylinder 38 via line 40, which acts as a holding reservoir for the argon, and comprises part of the argon recovery system. The argon pressure in the low pressure cylinder varies with time during the process cycle, but is greater than that of the LAR dewar 10 (14.7 psia in this embodiment), and less than that in the wafer processing tool 34. The pressure of the cylinder 38 may, for example, be at a pressure of approximately 300 psig during the process cycle. A fine metering valve 42 is located downstream of valve 36. This valve 42 is set to control the flow of argon and rate of de-pressurization of the processing tool 34 and vaporization vessel 12, 14 or 16, respectively. When the pressure of the tool 34 and vaporization vessel 12, 14 or 16, respectively, falls to 300 psig or less, valve 36 is closed and valve 44 is opened to vent the remaining small quantity of argon from the tool 34 and vaporization vessel 12, 14 or 16, respectively. The tool and vessel are at that time returned to a pressure of 14.7 psia.

The recovered argon in the low pressure cylinder 38 flows through a forward pressure regulator 46 to the argon liquefier 20. The set point of the forward pressure regulator is equal to the argon dewar pressure (14.7 psia in this embodiment). Vented argon is replaced in the system using a make-up argon supply line 48. Recycled argon could be advantageously filtered at the low pressures of the recycle circuit before being pressurized to the high pressures of the system.

In all embodiments of the invention, make-up argon may be provided in gaseous form to the LAR liquefier, or in liquid form to the LAR dewar.

Figure 2:
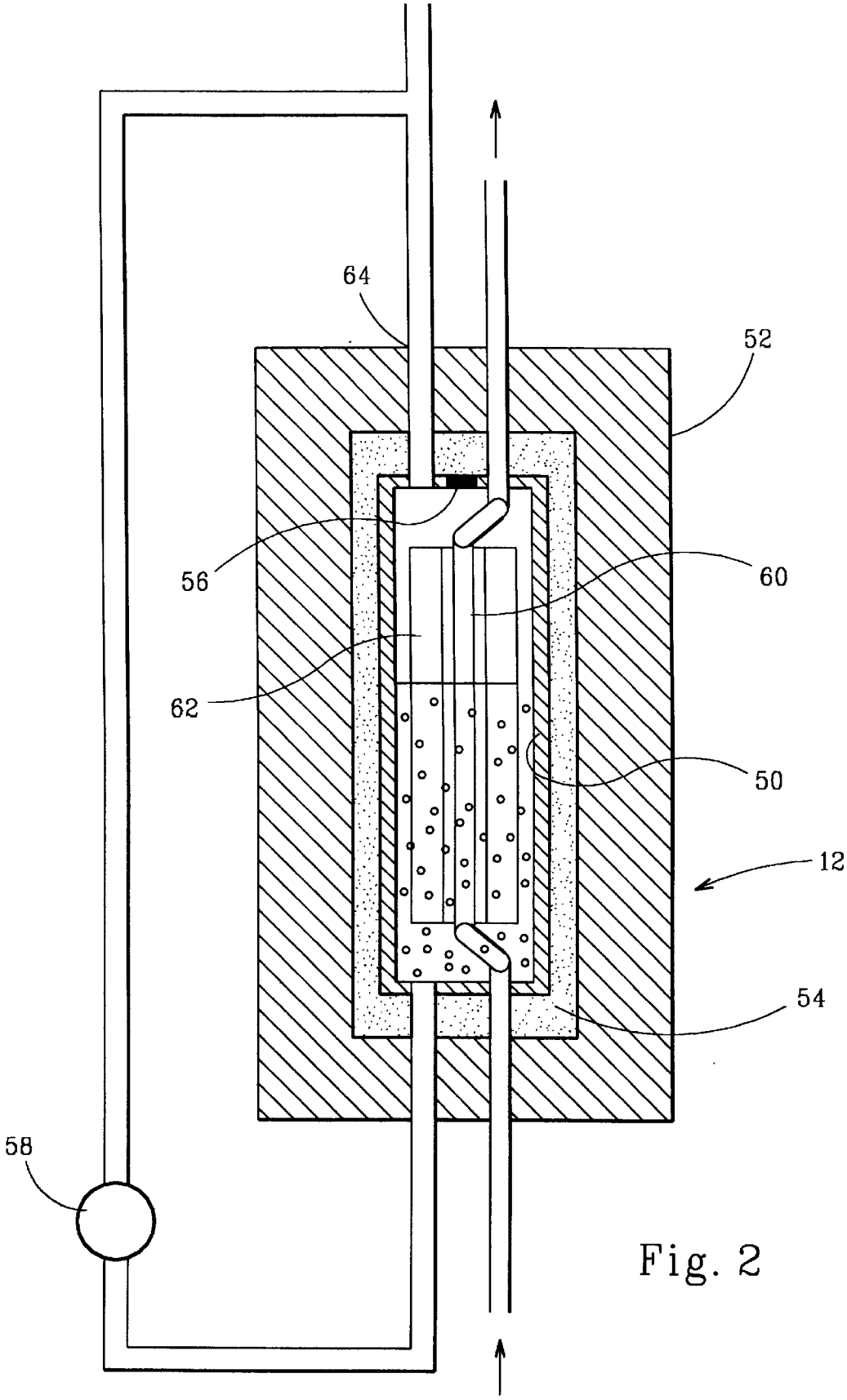
FIG. 2 is a cross-sectional illustration of a preferred embodiment of a vaporization vessel.

Detail of a typical vaporization vessel 12 is shown in FIG. 2. An inlet orifice 64 for LAR is provided at the top of the vessel 12. LAR flows downward from the LAR dewar into the vessel 12. The LAR is contained in an inner gas containing casing 50. The thermal mass of this inner casing 50 is minimized in order to minimize the initial cool-down time of the vessel 12 during LAR filling. The casing 50 is contained inside a thick-walled outer pressure containment casing 52. The temperature of the thick-walled outer pressure containment casing 52 remains near the ambient level. For this purpose, an intermediate thermal insulating layer 54 may be placed in the space between the casing 50 and the casing 52. A pressure equalizing orifice, or opening, 56 at the top of the casing 50 prevents any pressurization of the cold vessel. This opening may contain a de-misting medium, such as metal mesh or porous sintered metal to prevent LAR droplets from escaping the casing 50.

The quantity of LAR charge in the vaporization vessel 12 can be metered gravimetrically by measuring the change in weight of the vaporization vessel, or more preferably by measuring the depth of LAR in the casing 50. Depth measurements can be performed using a level sensor, or more preferably a differential pressure (DP) gauge 58 to measure the LAR liquid height as shown FIG. 2.

Heat can be transferred into the LAR using an electrical resistance heater in thermal contact with the LAR, or more preferably by thermal contact with a warming medium, such as flowing gaseous nitrogen (GAN) as shown in FIG. 2. FIG. 2 shows a means by which ambient temperature GAN or heated GAN can be brought into thermal contact with the argon. Heat transfer between the GAN and argon can be enhanced using an indirect heat exchanger 60 in the vessel 12. The heat exchanger 60 can consist of a plate and fin heat exchanger designed for high pressures, a coiled heat exchange tube, or more preferably a passageway with heat fins 62 brazed to its outside surface as shown in FIG. 2. Heat transferred from the GAN vaporizes the LAR, then raises the argon temperature to the ambient level. The pressurized argon then leaves the vaporization vessel 12 through the orifice 64 in the top of the vessel 12.

In an alternate embodiment of the invention, not shown, no argon recovery system is used. All argon is provided to the LAR dewar from the make-up argon line, and all used argon is vented from the system.

In another alternate embodiment of the invention, not shown, a single vaporization vessel is used. This embodiment can be used in those cases where the cycle period of the tool or other receiver is greater than or equal to the cycle period of the vaporization vessel. In this case a single vaporization vessel can provide high pressure argon at a rate sufficient to meet the requirements of the tool. This embodiment also contemplates another application for this invention in which the argon receiver consists of a bank of high purity argon cylinders, rather than a semiconductor wafer process tool. The cylinders are filled with high pressure (e.g. 2,500 psia) argon received from the vaporization vessel. After filling, the valves on the argon cylinders are closed. The filled argon cylinders are then removed and replaced with empty cylinders.

In other embodiments of the invention, substances other than argon can be produced at high pressure using constant volume vaporization and heating. The invention can be used to produce nitrogen, oxygen, helium, hydrogen or other low boiling point substances at high pressure through constant volume vaporization and heating. Such high pressure supply systems may be used, for example, to fill high purity gas cylinders to pressures of 2,000 psia to 6,000 psia.

Present means for producing pressurized argon include compression of gaseous or liquid argon in a mechanical compressor or cryogenic pump. Such equipment requires frequent maintenance, contaminates the gas with pneumatic or hydraulic fluid and/or particles, and can produce high noise levels. By completely eliminating compression or pumping machinery, this invention reduces equipment maintenance and gas contamination, and eliminates liquid cavitation and noise problems. The invention thus provides an improved means of supplying high purity gas at pressures as high as approximately 66,400 psia.

The present invention has been illustrated with regard to several preferred embodiments, but the full scope of the invention should be ascertained from the claims which follow.

What is claimed is:

1. A method of pressurizing a high purity gas to ultra high pressure while maintaining the high purity of the gas by isochoric vaporization, comprising the steps of;

a) providing a high purity gas in a liquefied physical state at a first pressure;

b) introducing said high purity gas in a liquefied physical state into a vaporization vessel at substantially said first pressure;

c) sealing said vaporization vessel after it is at least partially filled with said high purity gas in a liquefied physical state; and d) heating said vaporization vessel and said high purity gas in a liquefied physical state which at least partially fills said vessel to vaporize said high purity gas and to pressurize said high purity gas to said ultra high pressure while said vaporization vessel is sealed.

2. The method of claim 1 wherein said heating step d) is performed by indirect heat exchange of said high purity gas in a liquefied physical state with a heating fluid in said vaporization vessel.

3. The method of claim 1 wherein said ultra high pressure is at least 2,000 psia.

4. The method of claim 3 wherein said ultra high pressure is at least 8,000 psia.

5. The method of claim 4 wherein said ultra high pressure is in the range of approximately 10,000 to 67,000 psia.

6. The method of claim 1 wherein said high purity is at least 99.9% by volume of said gas.

7. The method of claim 1 wherein said high purity gas is at least 99.999% by volume of said gas.

8. The method of claim 1 wherein said high purity gas is at least 99.9999% by volume of said gas.

9. The method of claim 1 wherein said high purity gas is pressurized in one of a plurality of parallel connected vaporization vessels, wherein when one vaporization vessel is being filled by introduction of high purity gas in a liquefied physical state, the other vaporization vessels are dispensing said vaporized high purity gas at ultra high pressure and heating said high purity gas in a liquefied physical state, respectively.

10. The method of claim 1 wherein said high purity gas at an ultra high pressure is introduced into storage cylinders.

11. The method of claim 1 wherein said high purity gas at an ultra high pressure is delivered to a downstream semiconductor process as a source of pressurization.

12. The method of claim 11 wherein said high purity gas is recycled from said semiconductor process to a gas liquefier and then to said vaporization vessel.

13. The method of claim 1 wherein said high purity gas is selected from the group consisting of argon, oxygen, nitrogen, helium, hydrogen and mixtures thereof.

14. The method of claim 1 wherein said high purity gas is argon.

15. An apparatus for isochoric vaporization pressurizing a high purity gas to ultra high pressure while maintaining the high purity of the gas, comprising a) a liquefier for liquefying said high purity gas having at least two indirect heat exchange passageways through which a cooling medium passes in indirect heat exchange in one such passage and through which a high purity gas being liquefied passes in indirect heat exchange in another such passage;

b) a storage vessel connected to said liquefier to receive and store said high purity gas after it has been liquefied;

c) at least one vaporization vessel connected to said storage vessel having at least one orifice to receive and dispense said high purity gas, at least one valve to seal said vaporization vessel, an indirect heat exchanger in heat exchange with said vessel for heating said high purity gas, and means to sense the amount of said high purity gas in said vessel; and d) means for controllably dispensing said high purity gas at ultra high pressure from said vaporization vessel.

16. The apparatus of claim 15 wherein said means for controllably dispensing said high purity gas at ultra high pressure is a valved conduit connected from said vaporization vessel to a downstream semiconductor process apparatus.

17. The apparatus of claim 15 wherein said means for controllably dispensing said high purity gas at ultra high pressure is a valved conduit removably connected from said vaporization vessel to one or more downstream storage cylinders.

18. The apparatus of claim 15 wherein piping is provided to recycle said high purity gas at ultra high purity from said means to controllably dispense to said liquefier.

19. The apparatus of claim 15 wherein said vaporization vessel comprises three parallel connected vaporization vessels.

20. The apparatus of claim 15 wherein said vaporization vessel has said indirect heat exchanger situated inside said vessel.

21. The apparatus of claim 15 wherein said vaporization vessel has an outer pressure containment casing, an intermediate insulating layer, an inner gas containing casing and an indirect heat exchanger having passageways for flow of heating fluid through said indirect heat exchanger wherein said passageways have fins projecting outward to provide increased heat exchange surface.

* * * * *